US006619707B2

(12) United States Patent
Sucu et al.

(10) Patent No.: US 6,619,707 B2
(45) Date of Patent: Sep. 16, 2003

(54) NON-BIASED SAFETY LOCK

(76) Inventors: John Sucu, 149 Giles Rd., E. Kingston, NH (US) 03827; Francis L DeRubeis, 43 Grove St., Scituate, MA (US) 02066

( * ) Notice: Subject to any disclaimer, the term of this patent is extended or adjusted under 35 U.S.C. 154(b) by 0 days.

(21) Appl. No.: 09/851,019

(22) Filed: May 8, 2001

(65) Prior Publication Data

US 2002/0167180 A1 Nov. 14, 2002

(51) Int. Cl.[7] ..... E05C 3/04
(52) U.S. Cl. ..... 292/202; 292/DIG. 47
(58) Field of Search ..... 292/DIG. 47, DIG. 31, 292/DIG. 15, 342, DIG. 20, DIG. 30, 204, 203, 202, 238, 228

(56) References Cited

U.S. PATENT DOCUMENTS

| | | | | | |
|---|---|---|---|---|---|
| 391,119 | A | * | 10/1888 | Chisholm | 292/194 |
| 1,395,708 | A | * | 11/1921 | Grode et al. | 292/111 |
| 1,878,544 | A | * | 9/1932 | Schmidt | 292/194 |
| 2,064,721 | A | * | 12/1936 | Barnett | 292/240 |
| 2,356,427 | A | * | 8/1944 | Pressnall | 292/204 |
| 2,516,630 | A | * | 7/1950 | Hufnagel | 211/183 |
| 2,970,855 | A | * | 2/1961 | Fisher | 292/150 |
| 4,227,725 | A | * | 10/1980 | Lindquist et al. | 292/202 |
| 4,923,230 | A | | 5/1990 | Simpson | 292/67 |
| 4,932,694 | A | | 6/1990 | Carter, Sr. | 292/210 |
| 4,974,887 | A | | 12/1990 | Pucci | 292/228 |
| 5,536,052 | A | | 7/1996 | Maier | 292/63 |
| 5,542,721 | A | * | 8/1996 | Allen | 16/337 |
| 6,000,735 | A | * | 12/1999 | Jourdenais | 292/238 |
| 6,116,665 | A | * | 9/2000 | Subliskey | 292/241 |
| 6,321,411 | B1 | * | 11/2001 | Ikejiri et al. | 16/82 |

* cited by examiner

*Primary Examiner*—Robert Sandy
*Assistant Examiner*—Thomas Ho
(74) *Attorney, Agent, or Firm*—Grossman, Tucker, Perreault & Pfleger, PLLC

(57) ABSTRACT

A non-biased security lock for a double-hung window assembly is disclosed as well as a method of securing a double-hung window assembly using the sash lock. One or more security locks are installed in one or more recesses in the stile of an outer window sash. In an open, or locked, position, a locking tab is rotatably disposed about a pivot pin substantially perpendicular to the stile of the outer window sash. The locking tab arrests further displacement of the inner window sash when the header of the inner window sash encounters the extended locking tab. The locking tab is restrained by a pair of pinions; hence any force or load applied to the locking tab is transferred as moment to the pinions. In a closed, or unlocked, position, the locking tab is rotatably disposed about the pivot pin so that the upper surface of the locking tab is flush with or substantially below the outer surface of the stile of the outer window sash so that the sash lock does not hinder relative movement of the window sashes.

12 Claims, 3 Drawing Sheets

NON-BIASED SAFETY LOCK

BACKGROUND OF THE INVENTION

1. Field of the Invention

The present invention relates generally to a safety lock for a window assembly and a method of securing a window assembly using the lock. More particularly, the present invention relates to a novel self-contained, manually operable safety lock for a double-hung window assembly to limit the stroke of a sliding window sash relative to a stationary window sash and a method of securing a double-hung window assembly.

2. Background Art

Double-hung window assemblies commonly are used in modern building construction. A double-hung window assembly typically comprises a window frame and an inner and an outer window sash. The window sashes are contained separately in a pair of tracks located on the window frame to allow vertical or horizontal movement relative to each other.

To provide security, typically, sash locks or fasteners are provided. U.S. Pat. No. 4,923,230 to Simpson discloses a self-contained security lock for a double-hung window comprising (i) a casing, which is adapted to be disposed in a recess of the stile of the outer window sash, having an internal cavity, (ii) a face overlying the cavity, which surrounds the perimeter edges of the recess, (iii) a pivot lug, which is secured to the wall of the casing; (iv) a leaf spring, which is mounted in the casing, and (v) a manually retractable, elongated tumbler, which is pivotally mounted about the lug in the cavity.

The Simpson lock provides security by retarding the displacement of the inner sash relative the outer sash. Indeed, the tumbler is biased by the leaf spring to project through the opening of the casing and face creating a locking position. However, tumblers may over-rotate, which is to say that, in some instances, the inner sash engages the tumbler in such a manner as to cause the tumbler to not engage the back wall of the casing. Consequently, when over-rotated, the lock cannot retard the relative movement of the inner sash with respect to the outer sash.

U.S. Pat. No. 5,536,052 to Maier discloses an improvement to the Simpson sash lock, i.e., a sash lock with an improved tumbler that limits the rotation of the tumbler using an eccentric pivot bore. The Maier sash lock comprises a substantially similar device as Simpson, i.e., a forward-biased tumbler, pivotally mounted about a post in a housing. However, the post of the Maier sash lock extends into a pivot bore in a manner such that the pivot bore, the post, and the biasing spring urge the tumbler to engage the housing continuously. A problem with the Maier sash lock is that biasing springs can malfunction over time.

U.S. Pat. No. 5,542,721 to Allen discloses a sliding window or doorstop comprising a hinged planar tab pivotally mounted in a recess on the interior side of the outer sash or window frame. However, the Allen window stop is prohibitively expensive to install unless the stop is installed as part of the sash manufacturing process. Moreover, the recess must be molded or cut into the outer sash with precision, i.e., within a few thousandths of an inch. Furthermore, a bore to restrain a hinge pin must be drilled or cut on either side of the recess.

Thus, it would be desirable to provide a novel, non-biased sash lock that can be installed economically on double-hung windows that have already been installed and/or on new windows as they are being manufactured.

SUMMARY OF THE INVENTION

The present invention provides a method and device for retarding the sliding movement of a first member, e.g., an inner window sash, relative to a second member, e.g., an outer window sash, to provide safety and/or security. The present invention further provides a method and device for retarding the movement of an inner window sash relative to an outer window sash whereby the means for retarding the movement does not entail biasing the device. Finally, the present invention produces a method and device for retarding the movement of an inner window sash relative to an outer window sash that is simple to operate, manufacture, and install.

Accordingly, a security locking device is disclosed. One preferred use of the device is in a double-hung sash window, wherein the stile of the outer sash has a recess in which a sash lock is installed. The device comprises a casing, having an inner and outer perimeter wall and a bottom that define a well with an open end, wherein the casing is disposed in a recess therefor located in the stile of the outer window sash; and a locking tab, having a lifting handle, wherein the locking tab is rotatably mounted in the well of the casing.

Moreover, the present invention includes a system for securing a double-hung window assembly, the system comprising a plurality of recesses, wherein the plurality of recesses is installed in the stile of the outer window sash; and one or more locking devices, wherein the one or more locking devices are installed in an equal number of recesses.

Further, the present invention includes a method of securing a double-hung sash window, the method comprising the steps of: installing one or more recesses in the stile of the outer window sash; installing at least one locking device in one or more of the one or more recesses, wherein the at least one locking device includes a rotatably mounted locking tab that rotates in a direction substantially perpendicular to the direction of movement of the inner window sash; and disposing the locking tab in an open, or locked position, so that the disposed locking tab arrests any further movement of the inner window sash.

BRIEF DESCRIPTION OF THE DRAWINGS

The invention will be better understood by reference to the following more detailed description and accompanying drawings in which the same numbers refer to the same elements.

DETAILED DESCRIPTION OF THE INVENTION AND PREFERRED EMBODIMENTS THEREOF

Figure 4:
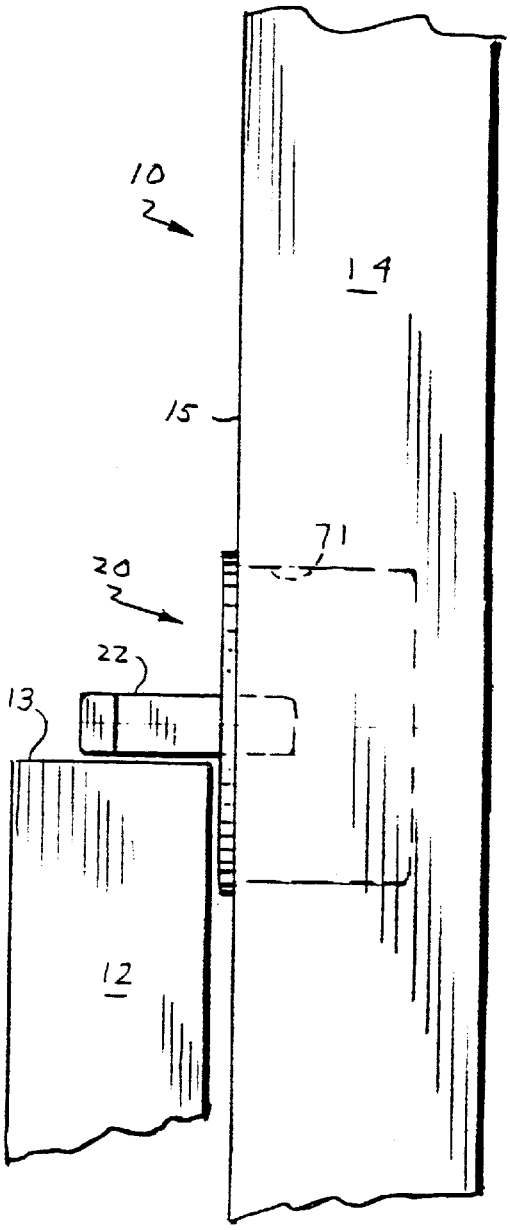
FIG. 4 is an elevation view of an illustrative embodiment of a double-hung window with a sash lock in the open, or lock, position.
Figure 5:
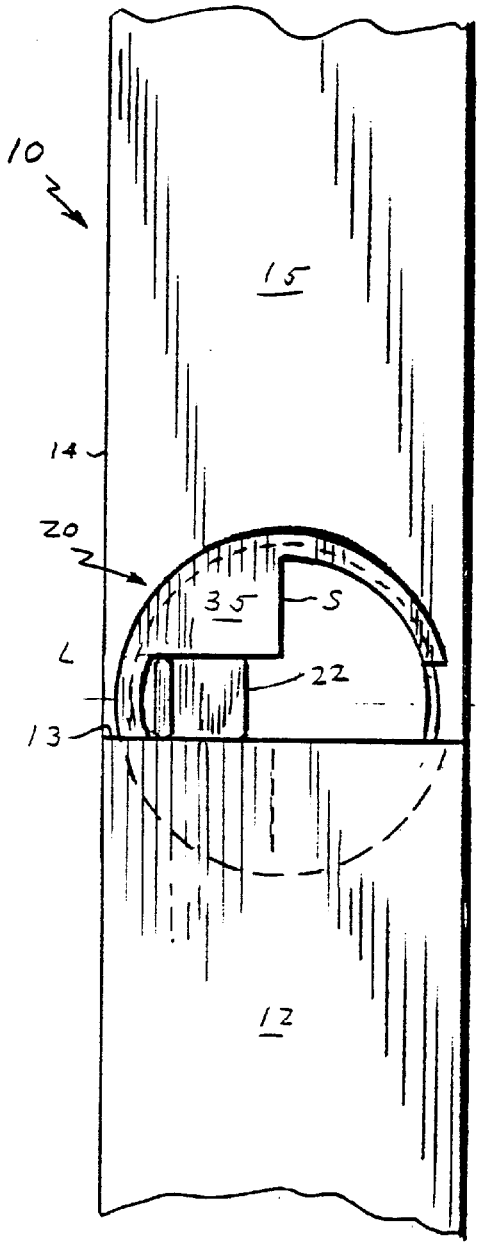
FIG. 5 is another elevation view of an illustrative embodiment of a double-hung window with a sash lock in the open, or lock, position.

Referring to FIGS. 4 and 5, there is shown an embodiment of a double-hung window 10 of a type that is well known in the art, comprising a main jamb frame (not shown), having two tracks, an inner window frame sash 12 and an outer window frame sash 14. The main jamb frame and sashes 12 and 14 can be manufactured from a variety of materials, e.g., wood, rigid plastic, composites, and/or metal. Preferably, the sashes 12 and 14 are generally square or rectangular in shape.

Preferably, the inner sash 12, having a header 13, is disposed in a first track in the frame of the window 10 in a manner that allows the inner sash 12 to displace, e.g., vertically, within the first track. Preferably, the outer sash 14, having a stile 15, is disposed in a second track in the frame of the window 10 in a manner that allows the outer sash 14 to displace, e.g., vertically, within the second track. Although the preferred embodiment of the present invention describes vertical displacement, the present invention can be practiced equally well when the sashes 12 and 14 displace horizontally with respect to each other.

The inner sash 12 and the outer sash 14 are installed, respectively, in a first and second track to permit vertical sliding movement relative to each other. In one embodiment of the present invention, a spacer (not shown) is disposed between the inner sash 12 and the outer sash 14 to separate the two sashes 12 and 14 to prevent contact between the inner sash 12 and outer sash 14 as they slide relative to one another. In another embodiment, the inner sash 12 and the outer sash 14 maintain substantially contiguous, frictional contact when the sashes 12 and 14 slide relative to one another.

An embodiment of a sash lock 20 relative to the two sashes 12 and 14 is shown in FIGS. 4 and 5. As the figures show, the sash lock 20 is installed permanently in the stile 15 of the outer sash 14. It should be obvious to those skilled in the pertinent art that the sash lock 20 can be disposed at virtually any location or multiple locations on the stile 15 of the outer sash 14 so that the inner sash 12 either cannot be raised at all or can be raised to a designated height to provide security while also allowing some ventilation before the header 13 of the inner stile 12 engages the locking tab 22 and further relative movement is arrested.

In a separate embodiment of the present invention, an array of sash locks 60 is installed in the stile 15 of the outer sash 14 to provide a variety of ventilation options. See FIG. 6. This array 60 will be described in greater detail below.

Furthermore, in yet another embodiment, an array of recesses 70 for one or more sash locks 20 is installed in the stile 15 of the outer sash 14. See FIG. 7. With this embodiment, sash locks 20 are moveable and relocatable, so that a single sash lock 20 can produce a variety of ventilation options. This alternate embodiment also will be described in greater detail below.

Referring once again to FIGS. 4 and 5, a locking tab 22 according to the present invention is shown in an open, or lock, position, which is to say, that the locking tab 22 is rotated about an axis substantially parallel to the direction of relative movement of the inner sash 12, approximately perpendicular to the stile 15 of the outer sash 14. In this mode, the locking tab 22 is disposed substantially in the path of the inner sash 12. As a result, the locking tab 22 arrests further sliding of the inner sash 12 relative to the outer sash 14 when the header 13 of the inner sash 12 engages the locking tab 22.

Figure 6:
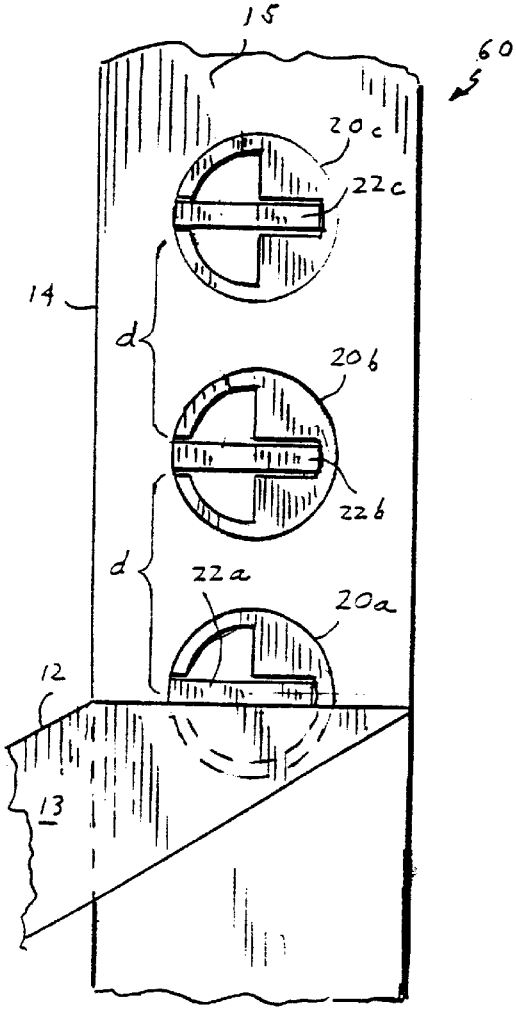
FIG. 6 is a perspective view of an illustrative embodiment of a double-hung window locking system having a plurality of sash locks.

Referring to FIG. 6, an embodiment comprising an array of sash locks 60 will be described. According to this embodiment, more than one sash lock 20 is installed in the stile 15 of the outer sash 14. For example, one sash lock 20*a* can be disposed and installed in the stile 15 of the outer sash 14 so that when the locking tab 22*a* of the sash lock 20*a* is open, i.e., in the lock position, the locking tab 22*a* engages the header 13 of the inner sash 12 to provide tight closure of the double-hung window 10.

A further, second sash lock 20*b* can be disposed and installed in the stile 15 of the outer sash 14 a short distance (d), e.g., 3 inches center to center, from the first sash lock 20*a*. As a result, when the first sash lock 20*a* is closed and the second sash lock 20*a* is open, the inner sash 12 can displace vertically a distance that corresponds approximately to the center to center spacing between the first sash lock 20*a* and the second sash lock 20*b* before further displacement is arrested by the locking tab 22*b* of the second sash lock 20*b*. A third sash lock 20*c* can be disposed and installed in the stile 15 of the outer sash 14 a short distance (d), e.g., 3 inches center to center, from the second sash lock 20*b*, so that when the first and second sash locks 20*a* and 20*b* are closed and the third sash lock 20*c* is open, the inner sash 12 can displace vertically a distance that corresponds approximately to the center to center spacing between the first sash lock 20*a* and the third sash lock 20*c* before further displacement is arrested by the locking tab 22*c* of the third sash lock 20*c*. Those skilled in the art can vary the number and the center to center spacing of sash locks 20 in an array 60. However, from a practical standpoint, the number of sash locks (n) in an array 60 is limited in accordance with the following formula:

$$n=x/(2*s)+1,$$

where the variable "x" is the dimension of the inner sash 12 that is disposed in the first track (in inches) and variable "s" is the desired center-to-center distance between sash locks 20 (in inches). For example, for a 36-inch inner sash 12, using 3 inch center-to-center spacing, a maximum of seven sash locks 20 are possible (n=36/(2*3)+1=7). Accordingly, assuming that the frame of the inner sash 12 is about two (2) inches thick, the second sash lock 20*b* produces about one (1) inch of ventilation (i.e., 3 inches center-to-center spacing—2 inch frame thickness) while a seventh sash lock (not shown) produces about 16 inches of ventilation.

Figure 7:
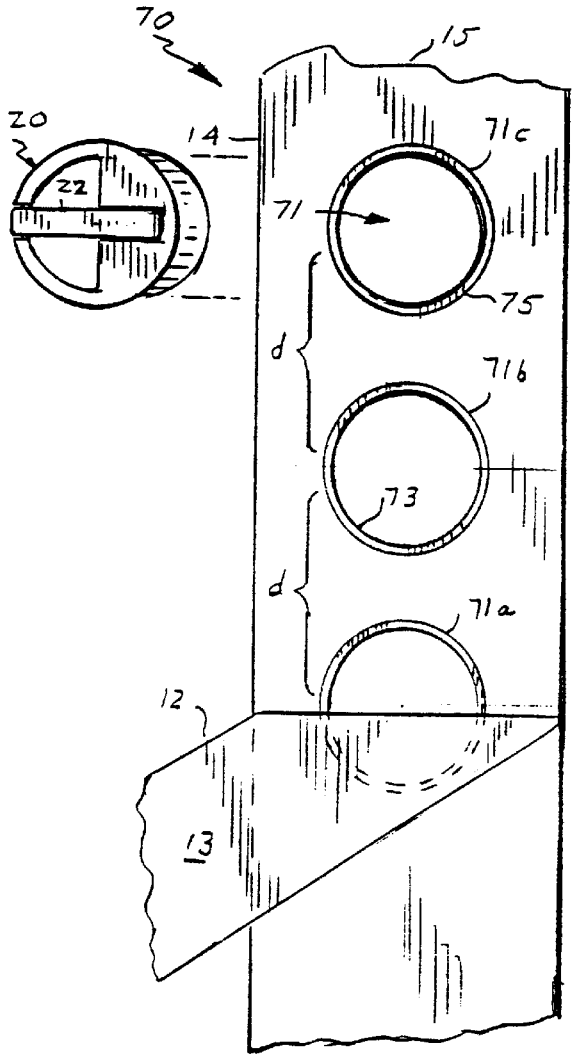
FIG. 7 is a perspective view of an illustrative embodiment of a double-hung window locking system having one or more sash locks and a plurality of recesses.

Referring to FIG. 7, another embodiment comprising an array of recesses 70 for one or more sash locks 20 will be described. Preferably, for this embodiment, only one sash lock 20 is used as a matter of economics. However, this embodiment can be practiced using more than one sash lock 20 without violating the scope and spirit of this disclosure. The novelty of this embodiment in comparison with the previously described embodiment is that the sash lock 20 is movable and relocatable. As a result, a single sash lock 20 can be disposed in any one of several recesses 71 that have been installed, e.g., pre-drilled, in the stile 15 of the outer sash 14. For example, one recess 71*a* can be disposed and installed in the stile 15 of the outer sash 14 so that when a sash lock 20 is installed in that recess 71*a* and the locking tab 22 of the sash lock 20 is open, i.e., in the lock position, the locking tab 22 engages the header 13 of the inner sash 12 to provide tight closure of the double-hung window 10. Furthermore, if the sash lock 20 is installed in a recess 71*b* in the stile 15 of the outer sash 14 a short distance (d), e.g., 3 inches center to center, from the first recess 71*a* and the sash lock 20 is open, the inner sash 12 can displace vertically a distance that corresponds approximately to the center to center spacing between the first recess 71*a* and the second recess 71*b* before further displacement is arrested by the locking tab 22 of the sash lock 20. Those skilled in the art can vary the number and the center to center spacing of recesses 71 in an array 70. However, from a practical standpoint, the number of recesses (r) in an array 70 is limited in accordance with the following formula:

$$r=x/(2*s)+1,$$

where the variable "x" is the dimension of the inner sash 12 that is disposed in the first track (in inches) and the variable "s" is the center to center distance between recesses 71 (in inches).

Further, preferably, the outer dimension of the recesses 71 is cut with precision, e.g., within one thousandth of an inch (0.001 in.) of the dimension of the casing 21 of the sash lock 20, so that a sash lock 20 can be inserted in and retracted easily from any of the plurality of recesses 71 in the array 70 while retaining substantial frictional contact between the inner wall 73 of the recess 71 and the outer perimeter 24 of the casing 21. Additional tolerance can be provided to account for temperature and humidity changes that can cause the material of the outer sash 14 to expand or shrink more than the sash lock 20.

As will be described below, the sash lock 20 includes a face 29 having a flange or a lip 26 of thickness T. Accordingly, each recess 71 further includes a shoulder 75 with which the flange or lip 26 is in contact such that the upper surface of the face 29 preferably is substantially at or below the surface of the stile 15 on the outer sash 14.

In a separate embodiment, a cover or plate (not shown) similar in function to a central power outlet, i.e., CPO, cover having an equal number of openings as there are recesses 71 in the array 70 is disposed over the array of recesses 70 and attached to the outer sash 14, e.g., with screws.

Figure 1:
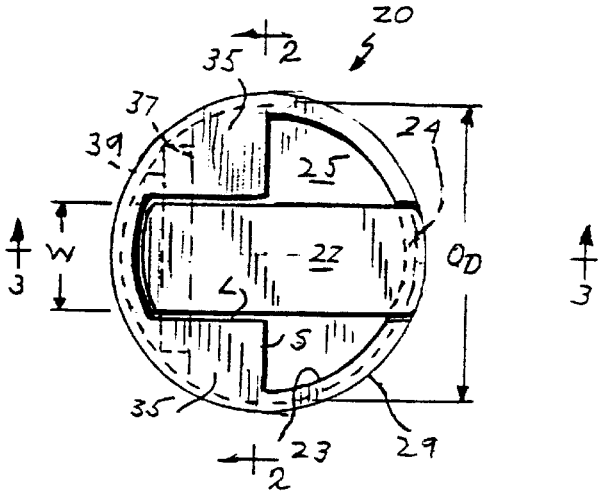
FIG. 1 is a top elevation view of an illustrative embodiment of the sash lock of the present invention in the closed, or unlock, position.
Figure 2:
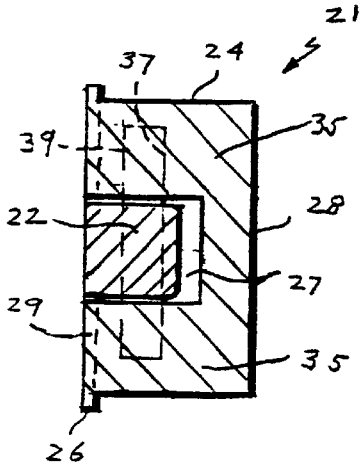
FIG. 2 is a side elevation view of an illustrative embodiment of the sash lock of the present invention in the closed, or unlock, position.
Figure 3:
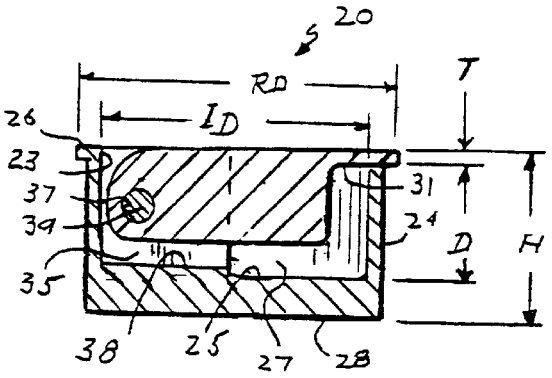
FIG. 3 is a side elevation view of an illustrative embodiment of the sash lock of the present invention in the closed, or unlock, position.

An embodiment of the sash lock 20 of the present invention will now be described with reference to FIGS. 1 through 3. Sash locks 20 can be fabricated from most rigid materials, e.g., metal, hard plastic, and composites. Preferably, a sash lock 20 includes a casing, or housing, 21, which is designed for installation in a recess 71 in the stile 15 of an outer sash 14. The casing 21 is substantially circular in shape; although, the present invention can be practiced with sash locks 20 having non-circular shapes, e.g., oval, square, rectangular, without violating the scope and spirit of this disclosure. However, recesses 71 for circular casing 21 are easier to install, e.g., by drilling, than for the shapes given as examples above.

The casing 21 comprises an outer perimeter wall 24, a base 28, and an inner well 27. The inner well 27 is defined further by an inner perimeter wall 23 and a bottom 25. The casing 21 has a wall thickness that is defined as the distance between the outer perimeter wall 24 and the inner perimeter wall 23 and a base thickness that is defined as the distance between the base 28 and the bottom of the well 25.

The casing 21 is manufactured by means that are well known to those skilled in the pertinent art, e.g., by one of molding, machining, die-casting, pressing and punching, and the like. Furthermore, the dimensions of the casing 21 can vary. For example, in one embodiment, which is used for double-hung window assemblies that offer outer sash stiles 15 having about 1¼ inches, i.e., about 31 mm, of exposed, usable dimension between the window frame and the glass window pane, the outer diameter OD of the casing 21 is about 14.27 mm, the inner diameter ID of the casing 21 is about 12.7 mm, the height H of the casing is about 12.7 mm, and the depth D of the well is about 11.43 mm. It should be obvious to those skilled in the art that other embodiments to and/or modifications, combinations, and substitutions of the present invention are possible, all of which are within the scope and spirit of the disclosed invention.

The preferably cylindrically shaped sash lock 20 includes further a face 29, having a lip 26 of thickness T. The outer dimension RD of the face 29 overlaps, i.e., RD is greater than OD, the outer perimeter wall 24 of the casing 21 and the inner periphery 73 of the recess 71, which produces the lip 26. The lip 26 is provided for aesthetic as well as practical reasons. Indeed, the lip 26 supports the casing 21 in the recess 71 and facilitates installation and removal of the sash lock 20. Indeed, one can extract a sash lock 20 from a recess 71 using, e.g., a fingernail, penknife or flat-head screwdriver, e.g., by inserting the fingernail, penknife blade or screwdriver tip under the lip 26 of the face 29 and forcing the lip 26 and then the sash lock 20 out of the recess 71.

The face 29 preferably is formed integrally with the material of the casing 21. However, the components can be formed separately and joined by one of the following: welding, adhesives, etc.

The dimensions of the face 29 can vary. However, in a preferred embodiment, the outer diameter RD of the face is about 17.45 mm and the thickness T is about 0/5 mm. It is important that the thickness T of the face 29 not interfere with the relative movement of the sashes 12 and 14. This can be accomplished best by recessing the face 29 into the recess 71 so that the upper surface of the face 29 is substantially flush or below the stile 15 of the outer sash 14.

The integrity of the lip 26 is purposely discontinuous where the handle 31 of the locking tab 22 rests on the casing 21 when the locking tab 22 is in the closed, i.e., unlocked, positioned. The handle 31 and the locking tab 22 will be discussed in greater detail below.

Preferably, the cylindrically shaped sash lock 20 also includes is a pair of pinions 35, which are disposed in the well 25 of the casing 21 contiguous to the inner perimeter wall 23. The pinions 35 are in interference fit with the locking tab 22 and support and restrain the locking tab 22 when the header 13 of an inner sash 12 engages the locking tab 22 during relative movement.

The shape of the pinions 35 is substantially triangular; however, it will become obvious to those skilled in the art to vary the shape of the pinions 35. Indeed, preferably, two sides of the triangle, i.e., the two sides S and L that are exposed in the well 27 of the casing 21, join approximately at a right angle to each other. The third side is arcuate and contiguous to a portion of the inner perimeter wall 23 of the well 27.

The pinions 35 are formed as a solid piece of material that is similar or dissimilar to the material of the casing 21. When made of similar materials, the pinions 35 are cast integrally with the casing 21. When the materials are dissimilar, the pinions 35 can be joined to the inner perimeter wall 23 for the entire depth D of the casing 21 by one of the following methods: welding, adhesives, e.g., epoxies, etc. Preferably, the pinions 35 are reverse mirror images of each other.

To provide additional support and restraint to the sash lock 20, a base plate 38 can be joined to the bottom 25 of the well 27, substantially between the lower ends of the pinions 35 where said lower ends meet the bottom 25 of the well 27.

Accordingly, any load or force applied to the locking tab 21 will not cause the lower ends of the pinions 35 to disengage from the inner perimeter wall 23 and rotate towards the opposing pinion 35 through excessive moment.

The dimensions of the pinions 35 can vary. Moreover, as mentioned above, it is preferred that the pinions 35 are reverse mirror images of each other. However, in a preferred embodiment, the dimension of the longer leg L of each pinion 35 is equal to about one-half times the inner diameter ID, i.e., the inner radius, which can be about 5.55 mm. The dimension of the shorter leg S of each pinion 35 is equal to about one-half times the difference between the inner diameter ID and the thickness W of the locking tab 22. In a preferred embodiment the locking tab 22 thickness W is about 6.35 mm. Accordingly, the shorter leg S of each pinion 43 is about 2.38 mm.

The sash lock 20 further includes a pivot bore 37 through which a pivot pin 39 is installed for the purpose of allowing the locking tab 22 to pivot, or rotate, about the pin 39. Preferably, the diameter of the pivot bore 37 is slightly greater, e.g., one-thousandth of an inch, than the diameter of the pivot pin 39. Furthermore, the pivot bore 37 is disposed so as to enter and exit the outer perimeter wall 24 of the casing 21 at a distance equal to approximately two-thirds of the height H of the casing 21 measured from the base 28 towards the lip 26. Moreover, the pivot bore 37 is further disposed so that the pivot bore 37 intersects the long leg L of the pinions 35 approximately at the The pivot pin 39, which, preferably has a cylindrical, bar-like shape, can be fabricated from similar or dissimilar material as the casing 21. The diameter of the pivot pin 39 is slightly less than the diameter of the pivot bore 37, with which the pivot pin 39 maintains a tight interference fit, to allow the locking tab 22 to rotate freely from an open to a closed position.

The locking tab 22 now will be described in detail. Preferably, the locking tab is made of the same or substantially similar material as the pinions 35. The locking tab 22 is disposed between the two pinions 35 so as to be in relatively tight interference fit with the pinions 35. One end of the locking tab includes a handle 31 and the opposite end includes a pivot bore 37 through which the pivot pin 39 is disposed. The end that includes the pivot bore 37 is disposed a reasonable distance from the inner perimeter wall 23 of the well 27 and, further, is rounded at the upper surface so that the tab 22 does not make frictional or other contact with the inner perimeter wall 23 when rotated to either of its operating modes.

In the closed, or unlocked, mode, the locking tab is rotatably disposed about the pivot pin 39 so that the locking tab 22 is substantially disposed in the well 27 of the casing 21. Preferably, the upper surface of the locking tab 22 is flush with or substantially below the upper surface of the face 29 so that the locking tab 22 does not interfere with the movement of the inner sash 12. In the open, or locked, mode, the locking tab 22 is rotatably disposed about the pivot pin 39 so that the locking tab 22 is substantially perpendicular to the stile 15 of the outer sash 14. In this orientation, the tab 22 can arrest the movement of the inner sash 12 when its header 13 contacts the extended tab 22. Force or load that is applied to the extended tab 22, e.g., by a sash header 13, is transferred as moment to the pinions 35, which restrain rotation of the tab 22 as with any cantilevered device.

The handle 31 of the locking tab 22 is fabricated so that there is no frictional or other contact between the locking tab 22 and the inner perimeter wall 23 of the well 27 as the tab 22 is rotatably disposed about the pivot pin 39. Furthermore, the handle 31 is shaped to rest on the casing 21 when in the closed mode. In FIG. 3, the handle 31 is shown in its preferred embodiment to be triangular in cross-section. However, this is merely an illustrative example. Indeed, the cross-sectional shape of the handle 31 also can be rectangular.

The preferred method of installing the sash lock 20 disclosed herein is simple. One or more recesses 71 are installed, e.g., bored, in the stile 15 of the outer sash 14. Preferably, each recess 71 has an inner diameter slightly greater than the outer diameter OD of the casing 21 so that, a sash lock 20 installed in the recess 71 maintains tight interference fit with the outer sash 14. A sash lock 20 is installed in one or more the recesses 71 so that the locking tab 22 can rotate in a direction that is substantially orthogonal to the relative movement of the inner sash 12 relative to the outer sash 14. For example, if the inner sash 12 moves vertically, the locking tab 22 is disposed substantially horizontally. Similarly, if the inner sash 12 moves horizontally, then the locking tab 22 is disposed substantially vertically.

Preferably, sash locks 20 are installed, e.g., by hand, without applying force to the upper surface of the face 29 to seat the sash lock 20 in the recess 71 or without using adhesives to maintain the sash lock 20 in the recess 71. In some instances, however, it might be necessary to apply a uniform load to the upper surface of the face 29, e.g., using a rubber hammer or mallet, to seat the sash lock 20 properly. In another embodiment, sash locks 20 can be installed in the recesses 71 using an adhesive, e.g., glue, epoxy, etc.

Although the present invention has been described in detail with reference to its preferred embodiments, it should be readily apparent to those skilled in the art that changes and modifications in form and details can be made without departing from the scope and spirit of this disclosure.

What is claimed is:

1. A system for securing a double-hung window assembly, wherein the double-hung window assembly has an inner window sash, having a header and a direction of movement, and an outer window sash, having a stile, the system comprising;

a plurality of recesses, wherein the plurality of recesses is installed in the stile of the outer window sash; and one or more locking devices, wherein the one or more locking devices are installed in an equal number of the plurality of recesses, wherein the one or more locking devices comprises:

a substantially circular casing, having an inner and an outer perimeter wall, said inner and outer perimeter walls extending continuously around a periphery of said casing at a uniform height and extending from a bottom of said casing to define a well with an open top; and a non-biased locking tab, having a lifting handle, wherein the locking tab is rotatably mounted in the well with a pivot pin extending through said locking tab and into said inner perimeter wall, said locking tab thereby being configured for extending at least partially out of said open top of said well by rotation about said pivot pin.

2. The system as recited in claim 1, wherein said one or more locking devices is positioned in the outer window sash and prevents sliding movement of the inner window sash, having a direction of movement, past the locking device when the locking tab is extended out of the casing.

3. The system as recited in claim 1, wherein the locking tab is in tight interference fit with a pair of pinions, which pinions are disposed in the well of the casing, to arrest any movement of the inner window sash relative to the outer window sash when the header of the inner window sash contacts the extended locking tab.

4. The system as recited in claim 1, wherein the locking tab is disposed to rotate about a first axis that is substantially parallel to a second axis, which second axis is defined by the direction of movement of the inner window sash.

5. The system as recited in claim 1, wherein the device further comprises:

a face that is fixedly attached to the open end of the well of the casing so as to overhang the inner and outer perimeter walls of the well to produce a lip.

6. The system as recited in claim 5, wherein the lip includes a discontinuity defining a space positioned in said face to receive the lifting handle of the locking tab.

7. The system as recited in claim 1, wherein a locking device is disposed in each of the plurality of recesses.

8. The system as recited in claim 1, wherein a single locking device is disposed in any one of the plurality of recesses.

9. The system as recited in claim 8, wherein the single locking device is movable and relocatable.

10. A double-hung window assembly, the assembly comprising:

an inner window sash, having a header and a direction of movement, movably disposed in a first track;

an outer window sash, having a stile, movably disposed in a second track;

one or more recesses installed in the stile of the outer window sash; and at least one locking device disposed in one of said recesses, said locking device comprising a substantially circular casing, having an inner and an outer perimeter wall, said inner and outer perimeter walls extending continuously around a periphery of said casing at a uniform height and extending from a bottom of said casing to define a well with an open top; and a non-biased locking tab, having a lifting handle, wherein the locking tab is rotatably mounted in the well with a pivot pin extending through said locking tab and into said inner perimeter wall, said locking tab thereby being configured for extending at least partially out of said open top of said well by rotation about said pivot pin.

11. A method of securing a double-hung window assembly, the assembly comprising an inner window sash, having a header and a direction of movement, and an outer window sash, having a stile, the method comprising the steps of:

installing one or more recesses in the stile of the outer window sash;

installing at least one non-biased locking device in at least one of said one or more recesses, wherein said at least one locking device comprises a substantially circular casing, having an inner and an outer perimeter wall, said inner and outer perimeter walls extending continuously around a periphery of said casing at a uniform height and extending from a bottom of said casing to define a well with an open top; and a non-biased locking tab, having a lifting handle, wherein the locking tab is rotatably mounted in the well with a pivot pin extending through said locking tab and into said inner perimeter wall, said locking tab thereby being configured to rotate about said pivot pin in a direction substantially perpendicular to the direction of movement of the inner window sash; and disposing the locking tab in an open, or locked position, so that the disposed locking tab arrests any further movement of the inner window sash past the extended locking tab.

12. The method as recited in claim 11, wherein the at least one locking device is relocatably installed so that the at least one locking device can be removed and installed in another of the plurality of recesses.

* * * * *